US012534167B1

(12) United States Patent
Tiancheng et al.

(10) Patent No.: US 12,534,167 B1
(45) Date of Patent: Jan. 27, 2026

(54) AUTONOMOUS VESSEL

(71) Applicant: Tiancheng Electrical Marine Equipment Pte. Ltd., Singapore (SG)

(72) Inventors: Li Tiancheng, Singapore (SG); Anna Huey Ling Soh, Singapore (SG)

(73) Assignee: Tiancheng Electrical Marine Equipment Pte. Ltd., Singapore (SG)

( * ) Notice: Subject to any disclaimer, the term of this patent is extended or adjusted under 35 U.S.C. 154(b) by 0 days.

(21) Appl. No.: 19/321,351

(22) Filed: Sep. 8, 2025

(30) Foreign Application Priority Data

Feb. 21, 2025 (SG) ..... 10202500472V

(51) Int. Cl.

| | |
|---|---|
| ***B63B 21/16*** | (2006.01) |
| ***B63B 79/15*** | (2020.01) |
| ***B63B 79/40*** | (2020.01) |
| *B63B 21/00* | (2006.01) |

(52) U.S. Cl.
CPC ..... *B63B 79/40* (2020.01); *B63B 21/16* (2013.01); *B63B 79/15* (2020.01); *B63B 2021/008* (2013.01); *B63B 2021/009* (2013.01)

(58) Field of Classification Search
CPC ..... B63B 79/40; B63B 79/15; B63B 21/16; B63B 2021/008; B63B 2021/009
See application file for complete search history.

*Primary Examiner* — Mathew Franklin Gordon
(74) *Attorney, Agent, or Firm* — Scully, Scott, Murphy & Presser, P.C.

(57) ABSTRACT

An autonomous vessel and method for maintaining precise position or trajectory during marine operations, such as cable or pipe laying or offshore construction and installation, are disclosed. The vessel includes multiple mooring lines anchored externally, a winch system with tension sensors, a position sensor, and a control system. The control system processes positional and tension data to detect deviations caused by environmental forces like wind, waves or currents. In response, it actuates the winch system to adjust mooring line lengths, counteracting forces and enabling controlled maneuvering within the mooring spread. An optional artificial intelligence module learns from historical data to predict dynamics and optimize adjustments along predefined waypoints. This reduces fuel use, enhances accuracy, and minimizes risks compared to conventional dynamic positioning systems. Applicable to vessels like barges or installation platforms.

20 Claims, 8 Drawing Sheets

AUTONOMOUS VESSEL

TECHNICAL FIELD

The present disclosure relates generally to autonomous marine vessel control systems. More specifically, it pertains to a method and apparatus for autonomously maintaining the position and/or trajectory of a vessel.

BACKGROUND

The marine environment presents significant challenges for marine operations which requires the vessel that maintains a fixed position or those which need to follow a fixed trajectory such as pipe and cable laying, installation, seabed levelling, drilling and amongst others. Specifically, environmental forces such as wind, waves and ocean currents can cause a vessel to deviate from its intended position. This loss of position-keeping and/or tracking ability, directly results in the inaccurate operations, such as placement of the cable or pipe on the seabed.

Marine operations involving the laying of subsea infrastructure, such as cables and pipelines, are critical for global telecommunications, energy transport, and offshore renewable energy sectors. These operations require a vessel to maintain a fixed position or follow a precise trajectory. The oceanic environment, however, presents substantial challenges to station-keeping and trajectory control due to various external disturbances. Environmental forces, including ocean currents, winds, waves, and swell, can disrupt a vessel's position and stability. In certain regions, such as the Arctic, hazards like ice floes and extreme weather further compound these operational difficulties.

Failures in station-keeping and/or trajectory control can result in significant negative consequences. Deviations from an intended path lead to the imprecise placement of cables or pipelines on the seabed. Such inaccuracies necessitate costly rework, including the repositioning or repair of misaligned infrastructure, thereby increasing project costs and timelines.

Conventional methods for station-keeping include dynamic positioning systems (DPS) and manual or automated mooring systems. A dynamic positioning system uses a vessel's own thrusters and propellers to actively counteract environmental forces. In deep waters or during prolonged operations, a continuous reliance on DPS leads to high fuel consumption and increased emissions.

Beyond positioning, other environmental factors create challenges. Turbidity from seabed disturbance can impair the visibility for remotely operated vehicles (ROVs) used to monitor the installation. The operational disruptions and infrastructure damage caused by these multifaceted environmental challenges underscore the deficiencies of current station-keeping technologies.

Therefore, there exists a need in the art for an improved system and method for vessel station-keeping and/or trajectory control during marine operations. A need exists for a solution that overcomes the limitations of conventional systems by enhancing positional accuracy, reducing reliance on fuel-intensive methods, mitigating operational and safety risks, and minimizing adverse environmental impacts, particularly in challenging and dynamic marine environments.

SUMMARY OF THE INVENTION

The following presents a summary to provide a basic understanding of one or more embodiments of the invention.

This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, an apparatus and/or method that facilitate an autonomous vessel are described.

According to an embodiment, an autonomous vessel comprises: a plurality of mooring lines, each extending from a different point on the vessel and having a distal end configured to be attached to an anchor or fixed point external to the vessel; a winch system mechanically coupled to the plurality of mooring lines, the winch system comprising a mooring line tension sensor configured to generate mooring line tension data; a vessel position sensor configured to generate positional data of the vessel; and a control system in operative communication with the winch system and the vessel position sensor. The control system is configured to: process the positional data and the mooring line tension data to determine a deviation of the vessel from a target position or trajectory caused by environmental forces; and in response to determining the deviation, generate and transmit a control signal to the winch system, causing the winch system to automatically actuate and adjust a length of one or more of the plurality of mooring lines to counteract the environmental forces and correct the deviation, thereby maintaining the vessel at the target position or causing the vessel to follow the target trajectory through controlled maneuvering within a mooring spread.

In some embodiments, the control system further comprises an artificial intelligence (AI) module, and the control system is configured to: utilize the AI module to learn a relationship between the environmental forces as derived from the positional data and a required adjustment to the length or tension of the mooring lines needed to counteract the environmental forces; and set the target position as a series of sequential waypoints along a pre-determined route, thereby causing the vessel to traverse along the route.

In some embodiments, the Artificial Intelligence (AI) module implements a predictive model of the vessel's dynamics, the model being configured to: process, as inputs, the positional data and the mooring line tension data and a current length or tension of the plurality of mooring lines; and generate, as an output, the control signal for the winch system, wherein the control signal specifies adjustments to the length of the one or more of the plurality of mooring lines predicted to counteract the environmental forces and move the vessel toward a subsequent waypoint in the series.

In some embodiments, the Artificial Intelligence (AI) module is trained using historical data, the historical data comprising positional data and corresponding line tension data collected during previous traversals of pre-determined routes as well as during other operational periods.

In some embodiments, the predictive model utilizes a time-series of positional data and line tension data from a preceding time interval to predict environmental forces affecting the vessel or vessel motion for a subsequent time interval.

In some embodiments, the autonomous vessel includes an ocean current sensor or a wind sensor to detect environmental forces affecting the vessel along the pre-determined route.

In some embodiments, the winch system comprises a dedicated winch for each of the plurality of mooring lines, and an encoder motor to measure a rotation of the dedicated winch.

In some embodiments, the plurality of mooring lines comprises four mooring lines, six mooring lines, eight mooring lines, or twelve mooring lines.

In some embodiments, the control system comprises at least one processor configured to control mooring lines, including a first set of mooring lines located at a bow portion of the vessel and a second set of mooring lines located at a stern portion of the vessel.

In some embodiments, the vessel is a barge, pipe-laying vessel or a cable-laying vessel or barge, wind turbine installation vessel, jackup, construction vessel, rock dumping vessel, tender-assisted drilling rig, accommodation vessel, semi-submersible rig, or submersible vessel.

According to another embodiment, a method for autonomously controlling a vessel comprises: receiving, at a control system, positional data from a vessel position sensor and tension data from one or more mooring line tension sensors; processing, by the control system, the positional data and tension data to determine a deviation of the vessel from a target position or trajectory caused by the environmental forces; and in response to determining the deviation, generating and transmitting, by the control system, a control signal to a winch system to cause the winch system to automatically actuate and adjust a length of one or more of a plurality of mooring lines to counteract the environmental forces and correct the deviation, thereby maintaining the vessel at the target position or causing the vessel to follow the target trajectory through controlled maneuvering within a mooring spread.

In some embodiments of the method, the control system further comprises an artificial intelligence (AI) module, and the control system is configured to: utilize the AI module to learn a relationship between the environmental forces as indicated by the positional data and a required adjustment to the length or tension of the mooring lines needed to counteract the environmental forces; and set the target position as a series of sequential waypoints along a pre-determined route, thereby causing the vessel to traverse along the route.

In some embodiments of the method, the Artificial Intelligence (AI) module implements a predictive model of the vessel's dynamics, the model being configured to: process, as inputs, the positional data and the mooring line tension data and a current state of the plurality of mooring lines; and generate, as an output, the control signal for the winch system, wherein the control signal specifies adjustments to the length of the one or more of the plurality of mooring lines predicted to counteract the environmental forces and move the vessel toward a subsequent waypoint in the series.

In some embodiments of the method, the Artificial Intelligence (AI) module is trained using historical data, the historical data comprising positional data and corresponding winch system adjustments data collected during previous traversals of pre-determined routes as well as during other operational periods.

In some embodiments of the method, the predictive model utilizes a time-series of positional data and line tension data from a preceding time interval to predict environmental forces affecting the vessel or vessel motion for a subsequent time interval.

In some embodiments of the method, the vessel includes an ocean current sensor or a wind sensor to detect environmental forces affecting the vessel along the pre-determined route.

In some embodiments of the method, the winch system comprises a dedicated winch for each of the plurality of mooring lines, and an encoder motor to measure a rotation of the dedicated winch.

In some embodiments of the method, the plurality of mooring lines includes four mooring lines, six mooring lines, eight mooring lines, or twelve mooring lines.

In some embodiments of the method, the control system comprises at least one processor configured to control mooring lines, including a first set of mooring lines located at a bow portion of the vessel and a second set of mooring lines located at a stern portion of the vessel.

In some embodiments of the method, the vessel is a barge, pipe-laying vessel or a cable-laying vessel or barge, wind turbine installation vessel, jackup, construction vessel, rock dumping vessel, tender-assisted drilling rig, accommodation vessel, semi-submersible rig, or submersible vessel.

BRIEF DESCRIPTION OF DRAWINGS

For a better understanding of the various described embodiments, reference should be made to the detailed description below, in conjunction with the following drawings in which like reference numerals refer to corresponding parts throughout the figures.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

The autonomous vessel system addresses the challenges of maintaining precise position and trajectory in marine environments, such as cable-laying, pipe-laying, or offshore construction and installation. By integrating a winch system with mooring lines, sensors for position and tension, and a control system optionally enhanced by an Artificial Intelligence (AI) module, the vessel can autonomously adjust to environmental forces like wind, currents, and waves. This ensures accurate maneuvering within a mooring spread without relying on traditional propulsion systems, reducing fuel consumption, operational costs, and human intervention. The mooring spread refers to the area defined by the anchors' positions.

The system operates by continuously monitoring vessel position and mooring line tensions. Deviations from a target position or predefined trajectory which defined as a series of waypoints, are detected and corrected through selective lengthening or shortening of mooring lines. This creates differential tensions that pull or slack the vessel in the desired direction. The Artificial Intelligence (AI) module, when included, enhances this by learning from historical data to predict environmental impacts and optimize adjustments, improving efficiency over time.

Figure 1:
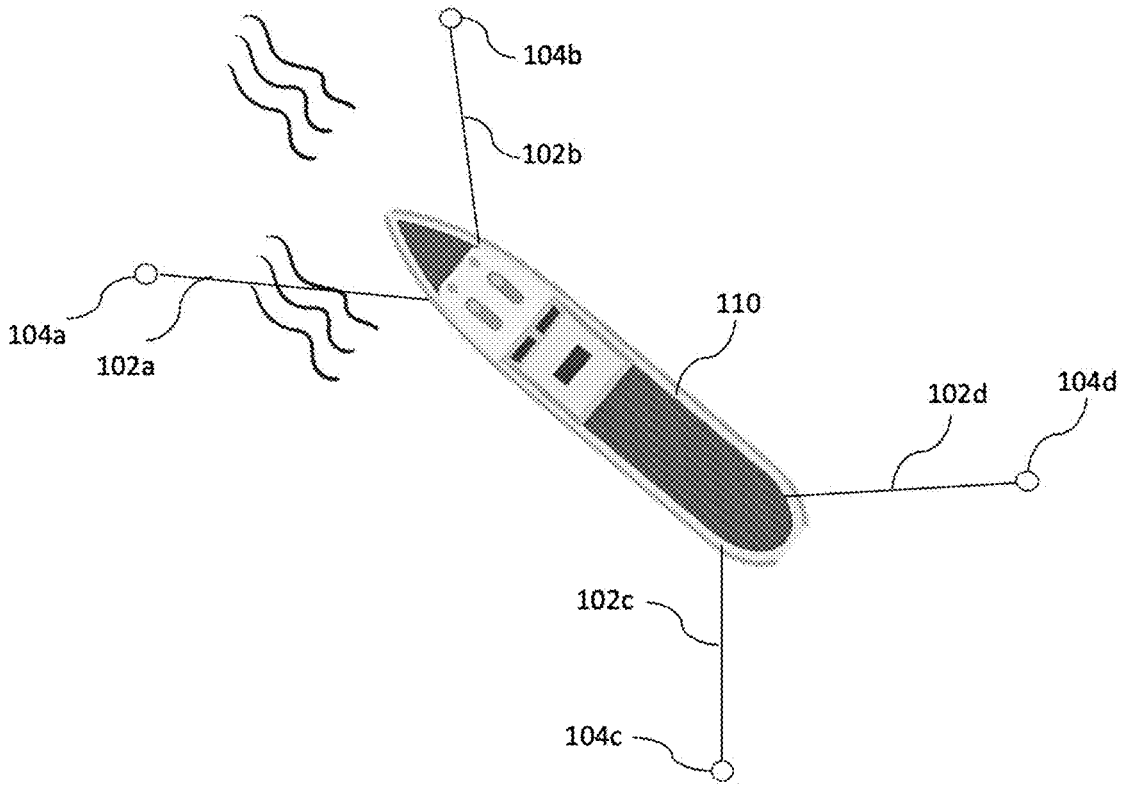
FIG. 1 is an autonomous vessel in operation at sea in accordance with one embodiment of the present disclosure.

FIG. 1 illustrates a vessel 110 in operation at sea in accordance with one embodiment of the present disclosure. The vessel 110 includes a plurality of mooring lines 102*a*-102*d*, each extending from a different point on the vessel and having a distal end configured to be attached to an anchor or fixed point external to the vessel (e.g., anchors 104*a*-104*d*). A winch system (not shown) is mechanically coupled to the plurality of mooring lines for controlling their length to create tension, such as by lengthening the mooring lines to create slack or shortening them to increase tension. The winch system includes a dedicated winch for each of the plurality of mooring lines (102*a*-102*d*) and an encoder motor (not shown) to monitor the movement of the cable or rope being spooled in or out, providing feedback for precise control and tension management. The winch system further comprises a mooring line tension sensor configured to generate mooring line tension data. The vessel 110 also includes a vessel position sensor (not shown) configured to generate positional data of the vessel, such as a GPS sensor that uses signals from a network of satellites to determine location, velocity, and time. The plurality of mooring lines (102*a*-102*d*) may be ropes, cables, steel, or synthetic materials. In some embodiments, the vessel 110 may include additional sensors, such as an ocean current sensor or a wind sensor, to detect environmental forces affecting the vessel. These sensors provide supplementary data to the control system, allowing for more accurate deviation calculations and proactive adjustments.

In an alternative embodiment four lines/anchors are arranged in a spread pattern, six lines in a hexagonal array for enhanced stability in high-current zones.

Figure 2:
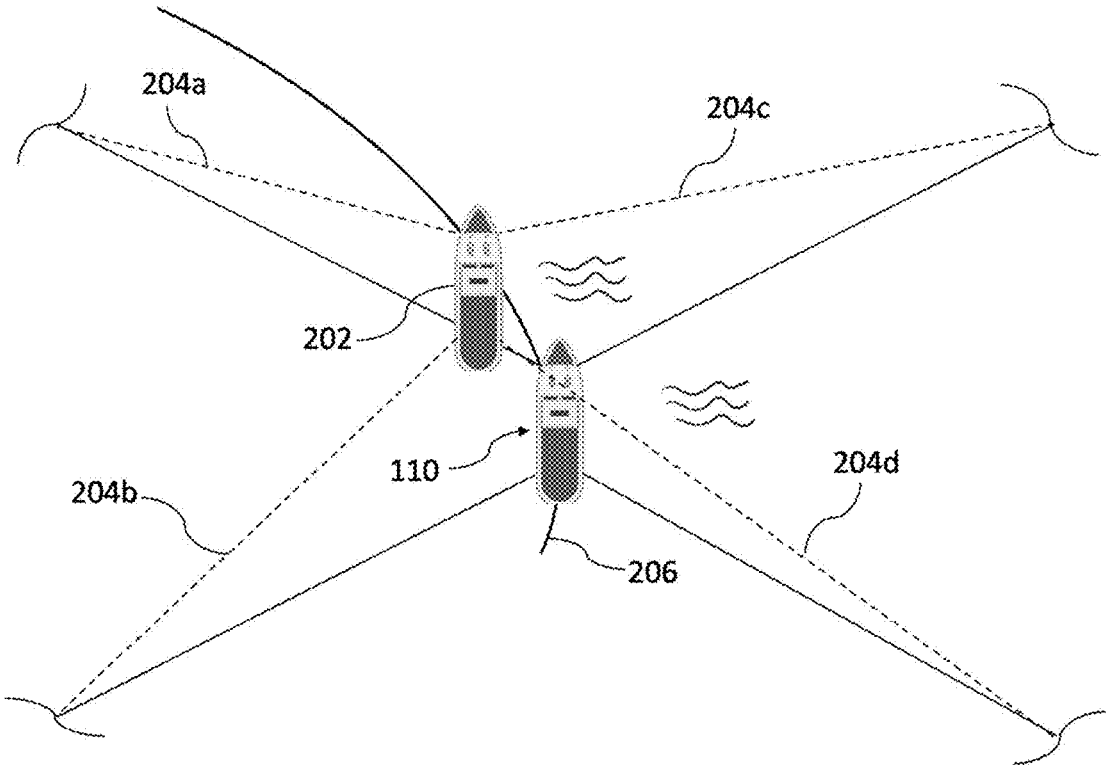
FIG. 2 is an autonomous vessel in operation at sea moving along a path in accordance with one embodiment of the present disclosure.

FIG. 2 illustrates the autonomous vessel 110 in operation at sea moving along a path 206 in accordance with one embodiment of the present disclosure. As the autonomous vessel 110 navigates along path 206 toward position 202, the winch system reels in mooring line 204*a*, thereby shortening its length, while simultaneously slacking mooring lines 204*b*-204*d*. This controlled adjustment allows the vessel 110 to maneuver within the mooring spread to follow the target trajectory. Such maneuvers are particularly useful for following a straight or curved-line path during pipe or cable-laying operations, where precise alignment with the seabed route is critical.

In an alternative embodiment in the curved paths, coordinate paired winches (e.g., shorten two bow lines differentially for yaw). In another embodiment, the vessel is equipped with real-time seabed mapping sonar to auto-adjust for uneven terrain, slacking lines over obstacles.

Figure 3:
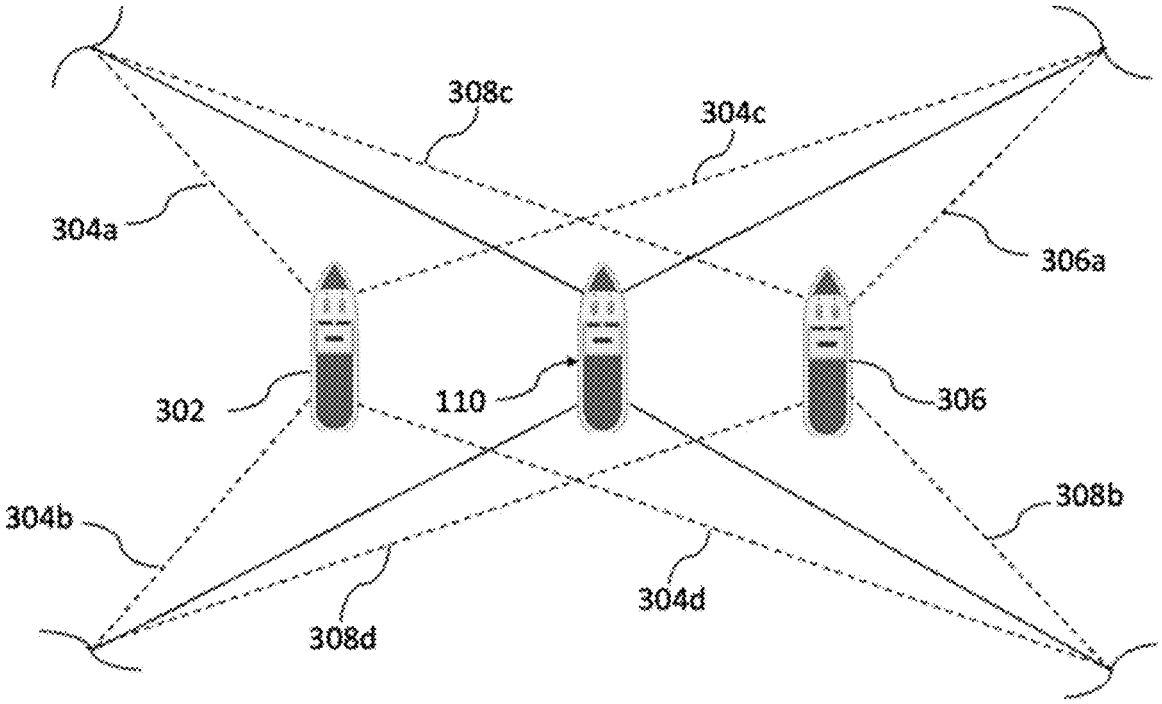
FIG. 3 is an autonomous vessel in operation at sea moving along a different path in accordance with one embodiment of the present disclosure.

FIG. 3 illustrates the autonomous vessel 110 in operation at sea moving along a different path in accordance with one embodiment of the present disclosure. To navigate to position 302, the winch system reels in mooring lines 304*a* and 304*b*, shortening their lengths, while slacking mooring lines 304*c* and 304*d*. Subsequently, to reach position 306, the winch system reels in mooring lines 306*a* and 306*b*, shortening their lengths, while slacking mooring lines 306*c* and 306*d* (now labeled as 308*b*-308*d* for clarity in the progression). This demonstrates the vessel's ability to follow sequential waypoints through precise mooring line adjustments. The system can handle complex paths, such as trajectory, lawnmower patterns, turns or adjustments around obstacles or other offshore structures, by coordinating multiple winches simultaneously, where the trajectory can be straight or curved.

In an alternative embodiment for multi-vessel ops (e.g., tandem laying), sync controls wirelessly with nearby ships, sharing tension data. In another embodiment, elastic mooring lines are used with variable stiffness for damping wave forces.

Figure 4:
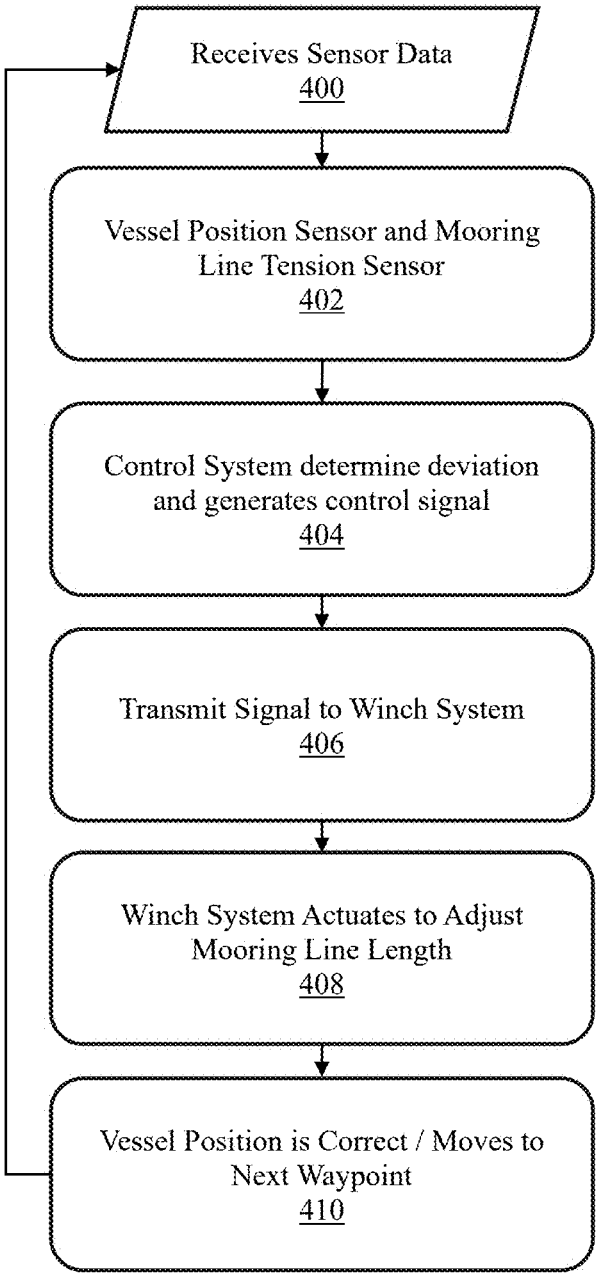
FIG. 4 is a flowchart illustrating the process of autonomously controlling a vessel in accordance with an embodiment of the present disclosure.

FIG. 4 is a flowchart 400 illustrating the process of autonomously controlling a vessel in accordance with an embodiment of the present disclosure. The autonomous vessel 110 includes a control system that receives sensor data from the vessel position sensor and mooring line tension sensor at step 402. At step 404, the control system determines the deviation from the target position or trajectory and generates a control signal. The control signal is transmitted to the winch system at step 406, causing the winch system to actuate and adjust the mooring line lengths at step 408. This results in the vessel's position being corrected or moving to the next waypoint at step 410.

Figure 5:
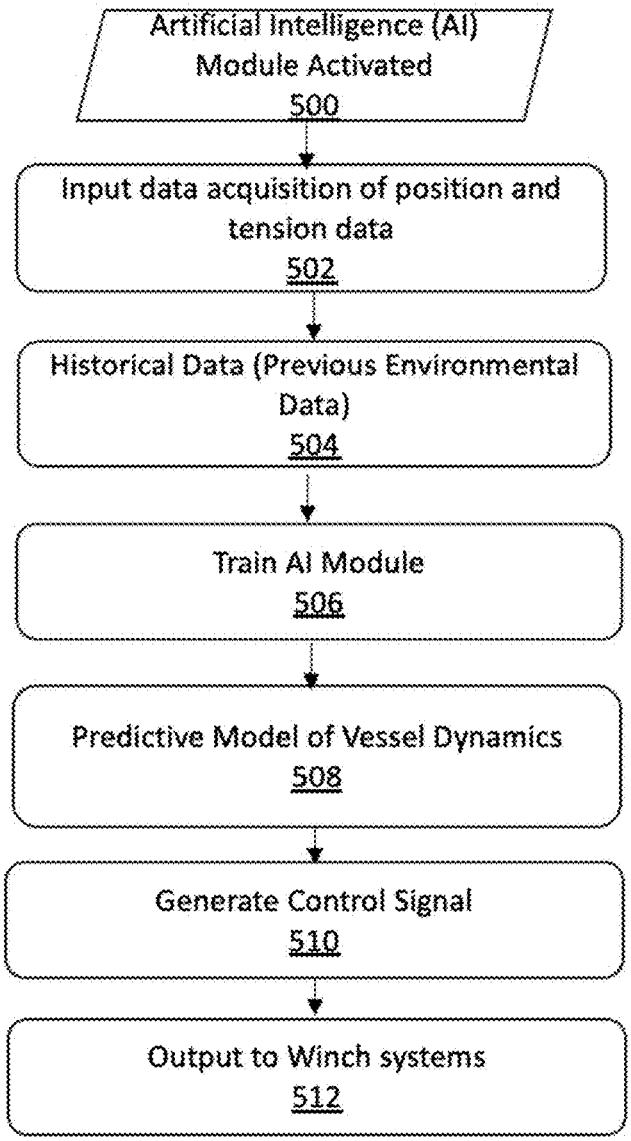
FIG. 5 is a flowchart illustrating the process of an AI module of the vessel in accordance with an embodiment of the present disclosure.

FIG. 5 is a flowchart 500 illustrating the process of an Artificial Intelligence (AI) module of the vessel in accordance with an embodiment of the present disclosure. The Artificial Intelligence (AI) module is activated at step 500. Input data acquisition of position and tension data occurs at step 502, incorporating historical data (e.g., previous environmental data) at step 504. The Artificial Intelligence (AI) module is trained at step 506 using this data. A predictive model of vessel dynamics is applied at step 508 to generate a control signal at step 510, which is output to the winch system at step 512. Training can occur offline using simulated or historical datasets or online during operations to adapt to specific vessel characteristics and routes.

Figure 6:
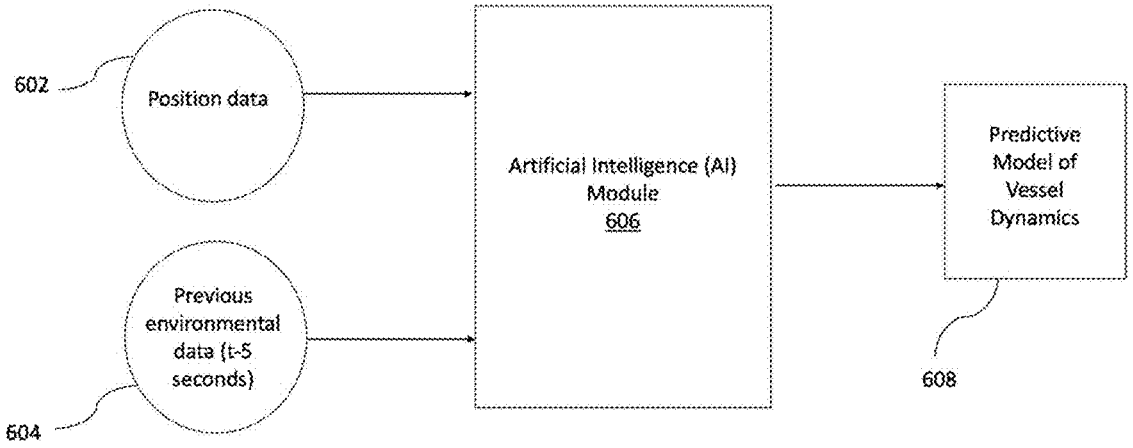
FIG. 6 is a flowchart illustrating the process of autonomously controlling a vessel in accordance with an embodiment of the present disclosure.

FIG. 6 is a flowchart illustrating the process of autonomously controlling a vessel in accordance with an embodiment of the present disclosure. The Artificial Intelligence (AI) module 606 processes inputs such as position data 602, previous environmental data (e.g., from t−5 seconds) 604, and other sensor inputs to apply a predictive model of vessel dynamics 608, generating outputs for winch adjustments. This time-series approach allows the model to forecast short-term environmental changes, such as gusts of wind or current shifts, enabling preemptive corrections.

Figure 7:
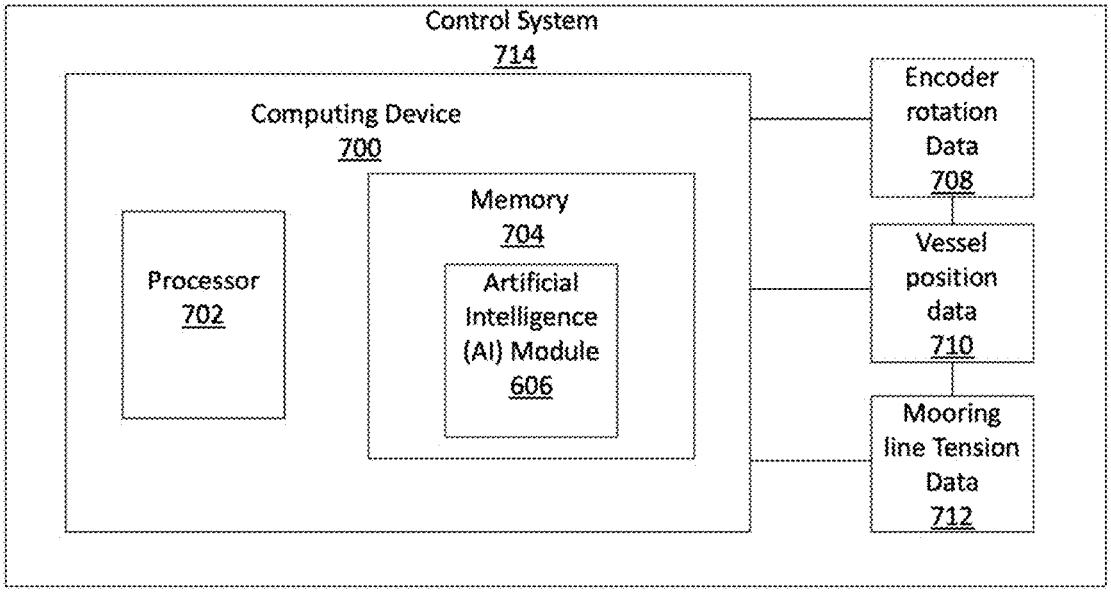
FIG. 7 is an Artificial Intelligence (AI) module in accordance with an embodiment of the present disclosure.

FIG. 7 illustrates an Artificial Intelligence (AI) module in accordance with an embodiment of the present disclosure. The computing device 700 includes a processor 702, memory 704, and the Artificial Intelligence (AI) module 606 integrated within the control system 714. Inputs include vessel position data 710, mooring line tension data 712, and encoder motor rotation data 708, enabling the Artificial Intelligence (AI) module to learn relationships between environmental forces and required mooring line adjustments. The processor 702 executes algorithms to process these inputs, while memory 704 stores historical data, trained models, and waypoint sequences. The control system 714 interfaces with the winch system and sensors, ensuring seamless integration.

Core Components of the Computing Device (700)

- Processor (702): This is typically a multi-core CPU or GPU-accelerated unit (e.g., NVIDIA Jetson series or similar edge Artificial Intelligence (AI) processors) responsible for executing algorithms in real-time. It processes incoming sensor data streams, runs the Artificial Intelligence (AI) model's inference, and generates control signals for the winch system. In expanded embodiments, the processor could support parallel computing for handling high-dimensional inputs, such as fusing data from optional wind/current sensors. For redundancy, distributed processing across bow and stern units could be implemented, ensuring failover if one processor encounters issues like overheating in harsh marine environments.
- Memory (704): Comprising RAM for runtime operations and non-volatile storage (e.g., SSDs) for persistent data. It stores historical datasets (e.g., past positional and tension logs), trained Artificial Intelligence (AI) models, waypoint sequences for routes, and firmware for the control system. Expansion: Memory could include dedicated caches for time-series buffering (e.g., 10-30 seconds of recent data) to support predictive modeling. In low-power variants for remote operations, flash memory with compression algorithms (e.g., using libraries like snappy) optimizes storage for long missions.
- Artificial intelligence (AI) Module (606): Integrated within the broader control system (714), this module is the "brain" that learns from inputs to predict and counteract deviations. It processes data to output winch adjustments, enabling autonomous maneuvers within the mooring spread. The module interfaces with sensors via standard protocols (e.g., CAN bus or Ethernet) and the winch system for actuation.
- Inputs:
  - Vessel Position Data (710): From GPS or inertial navigation systems (INS), providing real-time coordinates, velocity, and orientation.
  - Mooring Line Tension Data (712): From load cells or strain gauges on each line, indicating forces from currents or wind.
  - Encoder Motor Rotation Data (708): From winch encoders, tracking line lengths and speeds for precise control feedback.
- Control System (714): Acts as the orchestrator, interfacing the Artificial Intelligence (AI) module with external hardware. It ensures seamless data flow and includes safety overrides (e.g., tension thresholds to prevent line snaps).

Figure 8:
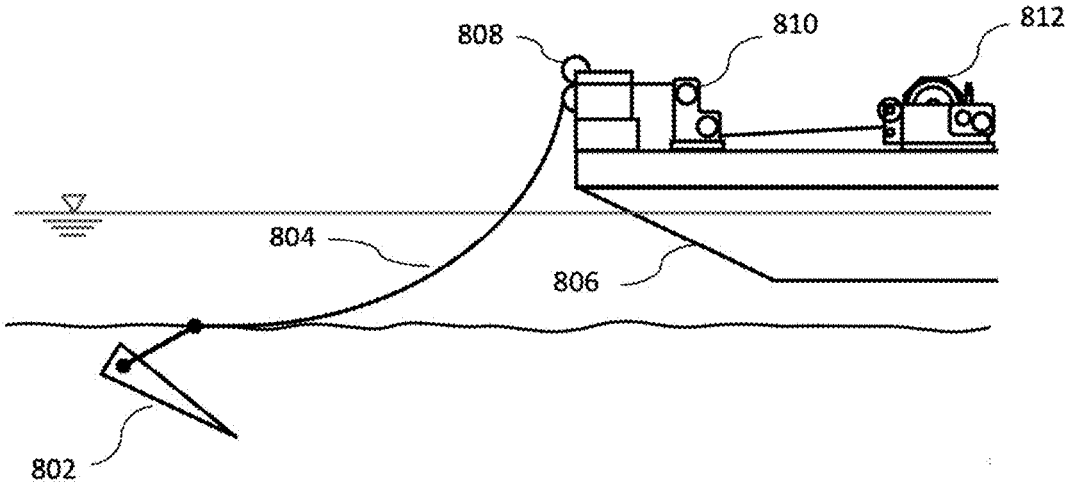
FIG. 8 illustrates a typical hardware configuration for a mooring point of the autonomous vessel, including an anchor, mooring line, fairlead, guide sheave, and winch, in accordance with an embodiment of the present disclosure.

FIG. 8 illustrates a typical hardware configuration for a mooring point of the autonomous vessel 806 (e.g., a barge), including anchor 802, mooring line 804, fairlead 808, guide sheave 810, and winch 812, in accordance with an embodiment of the present disclosure.

The anchor 802 is a flipper delta anchor, a high-holding power (HHP) plow-type anchor renowned for its reliability, excellent efficiency, and ability to penetrate various seabed conditions such as sand, mud, gravel, and other soil types with an open construction that ensures smooth penetration, no rotation during deployment, and easy dismantling for maintenance.

The mooring line 804 is typically a wire rope, optionally preceded by a mooring chain, designed to connect the anchor to the vessel while withstanding tensile forces from environmental loads.

The fairlead 808 is a guiding device, such as a closed chock or roller fairlead, that directs the mooring line from the winch to the exterior of the vessel, ensuring even distribution, preventing abrasion against the vessel's structure, and allowing free movement while minimizing excessive bending of the line.

The guide sheave 810 is a pulley or wheel that changes the level or direction of the mooring line, facilitating cable deflection up to 180 degrees and ensuring smooth routing from the fairlead to the winch drum.

The winch 812 is a single-drum electric winch, powered by an electric drive, capable of spooling the mooring line with pulling forces ranging from 0.5 to 80 tons or more, providing controlled actuation for lengthening or shortening the line during autonomous operations. This configuration (with elements 802-812) supports the multi-point mooring system, may depict variations such as different anchor deployments, line configurations for 4-point vs. 12-point setups, or integrations with sensors and winch controls for enhanced scalability across vessel sizes and operational needs.

In operation, the control system, which may include at least one processor, processes positional data and mooring line tension data to determine deviations caused by environmental forces. The Artificial Intelligence (AI) module learns from historical data, including time-series positional and tension data, to predict and counteract these forces. The system supports vessels with 4, 6, 8, or 12 mooring lines, divided into bow and stern sets for balanced control. For example, in a four-line setup, two lines at the bow (e.g., 102*a* and 102*b*) and two at the stern (e.g., 102*c* and 102*d*) allow for pitch and yaw adjustments. In larger configurations, such as twelve lines, additional lines provide redundancy and finer control, useful for heavy-lift operations like wind turbine installation.

The predictive model within the Artificial Intelligence (AI) module uses inputs such as current mooring line states (length and tension), positional data, and optional environmental sensor data (e.g., wind speed/direction or current velocity). It outputs specific winch commands, such as "shorten line 102*a* by 5 meters" or "slack line 102*d* to reduce tension by 10%." Training data may include historical traversals, simulated scenarios (e.g., via computational fluid dynamics for vessel hydrodynamics), or synthetically generated data to cover edge cases like severe weather.

The vessel types supported include barges for general transport, pipe-laying or cable-laying vessels/barges for subsea infrastructure, wind turbine installation vessels for offshore renewables, jackups for stable platforms, construction vessels for building operations, rock dumping vessels for seabed preparation, tender-assisted drilling rigs for oil/gas exploration, accommodation vessels for crew housing, semi-submersible rigs for deepwater drilling, and submersible vessels for underwater tasks. Each type benefits from the system's autonomy, improving operation accuracy, and enhancing safety by minimizing crew exposure to harsh conditions.

Safety features may include tension thresholds to prevent line breakage, emergency slack modes for rapid release. The control system can override Artificial Intelligence (AI) suggestions if deviations exceed predefined limits, ensuring reliability.

This detailed embodiment provides a robust framework for autonomous marine operations, adaptable to evolving technologies and regulatory requirements.

What is claimed is:

1. An autonomous vessel, comprising:

a plurality of mooring lines, each extending from a different point on the vessel and having a distal end configured to be attached to an anchor or fixed point external to the vessel;

a winch system mechanically coupled to the plurality of mooring lines, the winch system comprises a mooring line tension sensor configured to generate mooring line tension data;

a vessel position sensor configured to generate positional data of the vessel; and a control system in operative communication with the winch system and the vessel position sensor, the control system configured to:

process the positional data and the mooring line tension data to determine a deviation of the vessel from a target position or trajectory caused by environmental forces; and in response to determining the deviation, generate and transmit a control signal to the winch system, causing the winch system to automatically actuate and adjust a length of one or more of the plurality of mooring lines to counteract the environmental forces and correct the deviation, thereby maintaining the vessel at the target position or causing the vessel to follow the target trajectory through controlled maneuvering within a mooring spread.

2. The autonomous vessel of claim 1, wherein the control system further comprises an artificial intelligence (AI) module, and the control system is configured to:

utilize the AI module to learn a relationship between the environmental forces as derived from the positional data and a required adjustment to the length or tension of the mooring lines needed to counteract the environmental forces;

set the target position as a series of sequential waypoints along a pre-determined route, thereby causing the vessel to traverse along the route.

3. The autonomous vessel of claim 2, wherein the artificial intelligence (AI) module implements a predictive model of the vessel's dynamics, the model being configured to:

process, as inputs, the positional data and the mooring line tension data and a current length or tension of the plurality of mooring lines; and generate, as an output, the control signal for the winch system, wherein the control signal specifies adjustments to the length of the one or more of the plurality of mooring lines predicted to counteract the environmental forces and move the vessel toward a subsequent waypoint in the series.

4. The autonomous vessel of claim 2, wherein the artificial intelligence (AI) module is trained using historical data, the historical data comprising positional data and corresponding line tension data collected during previous traversals of pre-determined route as well as during other operational periods.

5. The autonomous vessel of claim 3, wherein the predictive model utilizes a time-series of positional data and line tension data from a preceding time interval to predict environmental forces affecting the vessel or vessel motion for a subsequent time interval.

6. The autonomous vessel of claim 2, includes an ocean current sensor or a wind sensor to detect environmental forces affecting the vessel along the pre-determined route.

7. The autonomous vessel of claim 1, wherein the winch system comprises a dedicated winch for each of the plurality of mooring lines, and an encoder motor to measure a rotation of the dedicated winch.

8. The autonomous vessel of claim 1, wherein the plurality of mooring lines comprises four mooring lines, six mooring lines, eight mooring lines or twelve mooring lines.

9. The autonomous vessel of claim 1, wherein the control system comprises at least one processor configured to control mooring lines, including a first set of mooring lines located at a bow portion of the vessel and a second set of mooring lines located at a stern portion of the vessel.

10. The autonomous vessel of claim 1, wherein the vessel is a barge, pipe-laying vessel or a cable-laying vessel or barge, wind turbine installation vessel, jackup, construction vessel, rock dumping vessel, tender-assisted drilling rig, accommodation vessel, semi-submersible rig or submersible vessel.

11. A method for autonomously controlling a vessel, the method comprising:

receiving, at a control system, positional data from a vessel position sensor and tension data from one or more mooring line tension sensors;

processing, by the control system, the positional data and tension data to determine a deviation of the vessel from a target position or trajectory caused by the environmental forces; and in response to determining the deviation, generating and transmitting, by the control system, a control signal to a winch system to cause the winch system to automatically actuate and adjust a length of one or more of a plurality of mooring lines to counteract the environmental forces and correct the deviation, thereby maintaining the vessel at the target position or causing the vessel to follow the target trajectory through controlled maneuvering within a mooring spread.

12. The method of claim 11, wherein the control system further comprises an artificial intelligence (AI) module, and the control system is configured to:

utilize the AI module to learn a relationship between the environmental forces as indicated by the positional data and a required adjustment to the length or tension of the mooring lines needed to counteract the environmental forces;

set the target position as a series of sequential waypoints along a pre-determined route, thereby causing the vessel to traverse along the route.

13. The method of claim 12, wherein the artificial intelligence (AI) module implements a predictive model of the vessel's dynamics, the model being configured to:

process, as inputs, the positional data and the mooring line tension data and a current length or tension of the plurality of mooring lines; and generate, as an output, the control signal for the winch system, wherein the control signal specifies adjustments to the length of the one or more of the plurality of mooring lines predicted to counteract the environmental forces and move the vessel toward a subsequent waypoint in the series.

14. The method of claim 12, wherein the artificial intelligence (AI) module is trained using historical data, the historical data comprising positional data and corresponding line tension data collected during previous traversals of pre-determined route as well as during other operational periods.

15. The method of claim 13, wherein the predictive model utilizes a time-series of positional data and line tension data from a preceding time interval to predict environmental forces affecting the vessel or vessel motion for a subsequent time interval.

16. The method of claim 12, includes an ocean current sensor or a wind sensor to detect environmental forces affecting the vessel along the pre-determined route.

17. The method of claim 11, wherein the winch system comprises a dedicated winch for each of the plurality of mooring lines, and an encoder motor to measure a rotation of the dedicated winch.

18. The method of claim 11, wherein the plurality of mooring lines includes four mooring lines, six mooring lines, eight mooring lines or twelve mooring lines.

19. The method of claim 11, wherein the control system comprises at least one processor configured to control mooring lines, including a first set of mooring lines located at a bow portion of the vessel and a second set of mooring lines located at a stern portion of the vessel.

20. The method of claim 11, wherein the vessel is a barge, pipe-laying vessel or a cable-laying vessel or barge, wind turbine installation vessel, jackup, construction vessel, rock dumping vessel, tender-assisted drilling rig, accommodation vessel, semi-submersible rig or submersible vessel.

* * * * *